US005336005A

United States Patent [19]

Moeck et al.

[11] Patent Number: 5,336,005

[45] Date of Patent: Aug. 9, 1994

[54] APPLICATOR DEVICE

[75] Inventors: Gerhard Moeck, Kirchehrenbach; Robert Finkenauer, Nuremberg, both of Fed. Rep. of Germany

[73] Assignee: Schwan-Stabilo Schwanhaeusser GmbH & Co., Nuremberg, Fed. Rep. of Germany

[21] Appl. No.: 165,406

[22] Filed: Dec. 10, 1993

[30] Foreign Application Priority Data

Dec. 29, 1992 [DE] Fed. Rep. of Germany ... 9217774[U]

[51] Int. Cl.[5] ..... A45D 40/06; A45D 40/04; A45D 40/20

[52] U.S. Cl. ..... 401/68; 401/75; 401/79; 401/70

[58] Field of Search ..... 401/68, 75, 76, 79, 401/86, 70

[56] References Cited

U.S. PATENT DOCUMENTS 3,358,699 12/1967 Bau ..... 401/75 X
4,997,299 3/1991 Ohba ..... 401/75
5,018,892 5/1991 Krueckel et al. ..... 401/75 M

FOREIGN PATENT DOCUMENTS 3728427 12/1983 Fed. Rep. of Germany .
3240785 5/1984 Fed. Rep. of Germany .

*Primary Examiner*—Steven A. Bratlie
*Attorney, Agent, or Firm*—Bachman & LaPointe

[57] ABSTRACT

An applicator device comprises a front portion and a gripping portion which are rotatable relative to each other to displace a stick of spreadable material axially by means of a screwthreaded spindle. At its rear part which is towards the gripping portion the front portion has a coupling part for non-rotatable connection to a nut member disposed in the gripping portion. The nut member has radially elastically resilient claw portions which can be brought into engagement with the screwthread of the screwthreaded spindle by the coupling part of the front portion bearing against the claws. The claw portions are disengaged from the screwthreaded spindle when the front portion is removed from the gripping portion. Disposed in the gripping portion between a part thereof and the screwthreaded spindle is a spring which, after being mechanically stressed in the forward feed movement of the screwthread spindle, moves the screwthreaded spindle back into its starting position in the gripping portion when the front portion is removed from the gripping portion.

10 Claims, 2 Drawing Sheets

APPLICATOR DEVICE

BACKGROUND OF THE INVENTION

One form of applicator device having a stick made of a material which can be applied to a surface by being rubbed or spread thereover, referred to herein as a spreadable material, as is to be found in DE 37 28 427 C1, comprises an elongate-like gripping portion having therein a central cavity in which a screwthreaded spindle is axially movable and a nut member is axially immovable, with the screwthreaded spindle being screwed through the nut member. The device comprises a casing front portion which is or can be non-rotatably connected to the nut member and is rotatable relative to the gripping portion to which it is or can be connected. The stick of spreadable material is disposed in the casing front portion by being cast therein and can be moved out of same by means of the screwthreaded spindle. However a problem with that applicator device is that exchanging a front portion with its exhausted or consumed stick of spreadable material, which is cast into the front portion, that is to say replacing a consumed front portion by an unused fresh front portion, involves a not inconsiderable degree of complication because for example it is first necessary for the screwthreaded spindle to be screwed back into its initial position in the elongate gripping portion before a fresh front portion with stick cast therein can be fitted to the gripping portion. Likewise, mounting the front portion on the elongate gripping portion, that is to say centering the two components relative to each other, may also involve a not inconsiderable degree of complication.

SUMMARY OF THE INVENTION

An object of the present invention is to provide an applicator device having a stick of spreadable material, in which replacement of a front portion thereof with stick by means of an unused fresh front portion with unused stick can be effected in a simple fashion without major complication.

Another object of the present invention is to provide an applicator device with a stick of a spreadable material, which is of a simple and uncomplicated design configuration while nonetheless permitting repeated re-use of the applicator device with a number of different sticks of spreadable material.

Still another object of the present invention is to provide an applicator device for spreadable material, which affords a simple structural configuration combined with simplicity of operation in replacing the stick of spreadable material therein.

In accordance with the principles of the present invention the foregoing and other objects are achieved by an applicator device comprising an elongate gripping portion, in the interior of which a screwthreaded spindle is axially movably disposed and a nut means through which the screwthreaded spindle is screwed is axially immovably disposed. The device further comprises a casing front portion which is non-rotatably connected or connectable to the nut means, the gripping portion and the casing portion which are connected or connectable to each other being rotatable relative to each other. A stick of a spreadable material is disposed as by casting in the casing front portion and can be moved out of seine by operation of the screwthreaded spindle. At its rear end part which is towards the elongate gripping portion the casing front portion has a coupling portion which is non-rotatably connected or connectable to the nut means, more specifically being connected or connectable to a plug-in portion on the nut means. The nut means has screwthread claw means of a radially elastically resilient nature which define the plug-in portion in such a way that in the assembled condition of the applicator device, they meshingly engage into the screwthreaded spindle by means of the coupling portion of the casing front portion and are out of engagement with the screwthreaded spindle in the condition of the applicator device for replacement of the stick of spreadable material, in which the casing front portion and the gripping portion are separated from each other. A spring means is disposed in the gripping portion between same and the screwthreaded spindle, the spring means being mechanically stressed in the forward feed movement of the screwthreaded spindle and being operable to move the screwthreaded spindle beck into its initial position into the gripping portion when the casing front portion is removed from the gripping portion.

As will be noted in greater detail hereinafter in relation to a preferred embodiment of the invention, the applicator device according to the invention enjoys the advantage that it is possible in a simple uncomplicated fashion to withdraw the casing front portion from the gripping portion and thus to replace the casing front portion by a fresh front portion with a stick of spreadable material cast therein. With the applicator device according to the invention therefore the stick of spreadable material is cast directly into the casing front portion, by a procedure which is known per se and which therefore does not need to be described herein. In that respect the stick can be produced directly with a shaped applicator end part. By virtue of the fact that the nut means has the radially resilient claw means which in the assembled condition of the applicator device meshingly engage into the screwthreaded spindle and which in the disassembled condition of the applicator device, that is to say, when the front portion and the gripping portion have been separated from each other, are moved radially away from the screwthreaded spindle so that the screwthreaded spindle can move freely in relation to the nut means, the screwthreaded spindle is automatically moved back into the elongate gripping portion by the relief of stress of the spring means when the applicator device is in the disassembled condition, so that there is no need for the screwthreaded spindle to be moved back into the gripping portion by a screwing movement, which involves further trouble and complication.

A preferred feature of the invention provides that the coupling means at the rearward end part of the casing front portion, and the plug-in portion of the nut means, are of cross-sectional profiles which are matched to each other in respect of shape and which differ from a conical shape, and conical longitudinal profiles which are matched to each other in respect of shape.

In that arrangement it has been found particularly desirable if the coupling means of the casing front portion is of a polygonal cross-sectional sectional profile and a rearwardly enlarging longitudinal profile because such a design configuration makes it easily possible for such a casing front portion to be fitted to the elongate gripping portion, thereby to combine those components together to form the applicator device, while at the same time guaranteeing a non-rotatable connection between the casing front portion and the nut means in the gripping portion, so that the axially immovable nut means can be rotated by means of the casing front portion in the elongate gripping portion, so that the screwthreaded spindle which is prevented from rotating in the gripping portion is screwed through the nut means and the stick of spreadable material can thus be extended from the casing front portion as desired.

After a stick of spreadable material has been suitably disposed in the casing front portion as by casting, it is advantageous if the casing front portion is closed at its rearward end part by means of a closure body which is disposed in the interior of the casing front portion and which is arranged displaceably therein, and if a coupling portion for connection to the closure body is provided at the front end of the screwthreaded spindle. The above-mentioned coupling portion not only makes it possible to move the closure body forwardly in the casing front portion as desired, but there is also the advantage that it is possible to compensate for manufacturing tolerances in respect of the individual components of the applicator device, by virtue of the provision of the coupling portion.

In a preferred feature of the invention the closure body is of a piston-like configuration with a fixing projection for the coupling portion. The piston- like closure body not only provides for ready forward movement of the spreadable stick material which is cast into the casing front portion, but it also provides for sealing closure of the casing front portion at its rearward end part, which is important particular when dealing with waterproof texture materials. Particularly in relation to such materials it may be desirable for the corresponding unused fresh casing front portion to be not only sealed off by means of the piston-like closure body, but also closed off by means of an additional sealing member which is removed from the casing front portion before the latter is then fixed to the gripping portion of the device.

In a preferred feature of the invention, to provide an applicator device of a simple design configuration with the option of ease of assembly, the spring means is disposed between a rearward contact or support portion of the screwthreaded spindle and a forward contact or support portion of the gripping portion, around the screwthreaded spindle, in such a way that the above-mentioned coupling portion projects with a part thereof out of the gripping portion when the casing front portion is removed from the gripping portion and thereby the nut means is out of engagement with its claw means from the screwthreaded spindle, whereby the spring means can be mechanically relieved of stress.

In that arrangement, in a preferred feature, the above-mentioned rearward contact or support portion of the screwthreaded spindle serves not only as a support means for the rearward end part of the spring means but also serves at the same time for linearly guiding the screwthreaded spindle in the interior of the gripping portion along longitudinal ribs in the interior of the gripping portion, thereby providing that the screwthreaded spindle is non-rotatably disposed in the interior of the gripping portion.

The fact that the coupling portion projects with a part thereof out of the gripping portion when the casing front portion is removed means that it is readily possible to combine an unused fresh casing front portion with its stick cast therein with the elongate gripping portion because the front part of the coupling portion provides for centering of the components relative to each other.

The casing front portion and the elongate gripping portion can be connected together in a simple fashion without involving a considerable amount of force if, in accordance with another preferred feature, the gripping portion is connected to the casing front portion along a connecting part which is of a resiliently yielding nature. In that respect it has been found desirable for the connecting part of the gripping portion to have at least one longitudinal slot. That at least one longitudinal slot provides for a resilient configuration of the connecting part, and also affords the further advantage that the or each longitudinal slot can be invisibly covered by the casing front portion when fitted on to the gripping portion so that the longitudinal slots are no longer visible to the exterior of the assembled applicator device, and thus cannot have an adverse effect on the appearance thereof.

The casing front portion is preferably designed for a cast stick of a diameter of the order of magnitude of between 2.5 and 5 millimetres.

Further objects, features and advantages of the present invention will be apparent features the following description of a preferred embodiment.

DESCRIPTION OF THE PREFERRED EMBODIMENT

Figure 1:
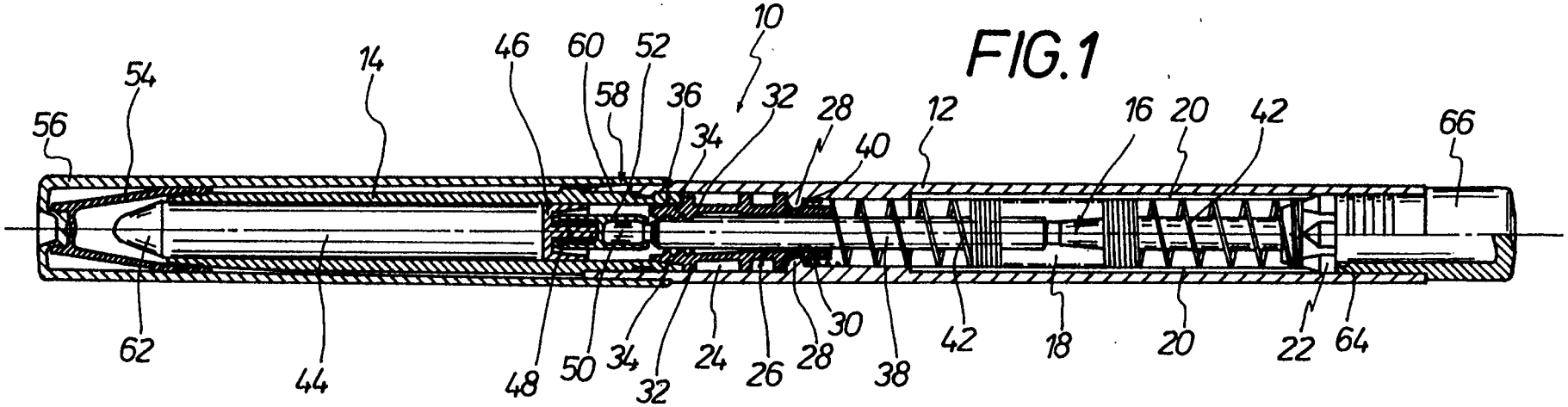
FIG. 1 is a view in longitudinal section through a complete applicator device in the unused original condition in which it is stored or transported, with a protective cap thereon.

Referring firstly to FIG. 1, shown therein in longitudinal section is a preferred embodiment of the applicator device according to the invention which is generally identified by reference numeral 10 and which comprises a shaft-like or elongate gripping or handle portion 12 and a casing front portion 14 which can be fitted on to the gripping portion 12 and removed therefrom as necessary. The gripping portion 12 has a central cavity 18 therein, in which an elongate screwthreaded spindle 16 is axially movably disposed, while being prevented from rotating in relation thereto. For that purpose the gripping portion 12 is provided in its internal cavity 18 with longitudinal ribs 20 while the screwthreaded spindle 16 is provided at its rearward end part, towards the right in FIG. 1, with a contact or support portion 22 provided with grooves or channels through which the longitudinal ribs 20 extend. The co-operation of the longitudinal ribs 20 and the grooves or channels in the portion 22 provide that the screwthreaded spindle 16 is arranged non-rotatably in the cavity 18 in the gripping portion 12 while at the seine time affording linear guidance for the screwthreaded spindle 16 along the longitudinal ribs 20 in the axial direction of the gripping portion 12.

A nut member as indicated at 26 is axially immovably and rotatably mounted in the internal cavity 18 of the gripping portion 12, more specifically in the interior of a front portion 24 thereof. To provide that the nut member 26 is axially immovably and rotatably mounted in the gripping portion 12, the gripping portion 12 is provided with an inwardly extending projection 28 such as an annular collar while the nut member 26 has a recess 30 extending therearound, so positioned that the projection 28 engages into the recess 30.

The nut member 26 is provided with radially elastically resilient screwthread claw portions 32 forming a plug-in portion 34 for the casing front portion 14, more specifically for co-operating with a coupling portion 36 of the casing front portion 14. The claw portions 32 and the coupling portion 36 are of cross-sectional profiles which are matched to each other in respect of shape and which differ from a circular shape, and are of a conically enlarged configuration in regard to their longitudinal profiles which are matched to each other in respect of shape, so that, when a casing front portion 14 is fitted on to the gripping portion 12, the casing front portion 14 is subjected to a self-centering effect on the gripping portion 12 while at the same time the casing front portion 14 is non-rotatably connected to the nut member 26. In the condition in which the casing front portion 14 is fitted on to the gripping portion 12, the conical coupling portion 36 of the casing front portion 14 and the corresponding conical plug-in portion 34 of the nut member 26 or the claw portions 32 thereof provide for meshing engagement of the latter into the screwthreaded portion 38 of the screwthreaded spindle 16. In that engagement condition the claw portions 32 are mechanically stressed in a radial direction inwardly.

Disposed in the interior of the gripping portion 12 between a front contact or support portion 40 thereof, which is towards the left in FIG. 1 and which can be formed for example by the above-mentioned inwardly projecting projection 28, and the rearward contact or support portion 22 on the screwthreaded spindle 16 towards the right in FIG. 1 is a spring member 42 in the form of a compression coil spring. The spring member 42 is shown as being interrupted in its central part in FIG. 1. It will be clearly seen from FIG. 1 however that the spring member 42 with its coils surrounds the screwthreaded spindle 16.

A stick 44 of a spreadable material is formed as by casting in the casing front portion 14 of the applicator device 10, as far as a closure body which is indicated at 46 towards the right-hand end of the casing front portion 14 in FIG. 1. The closure body 46 is of a generally piston-like configuration and seals off the casing front portion 14 in a rearward direction, that is to say towards the right in FIG. 1. It has a central fixing projection as indicated at 48 which extends in the axial direction of the applicator device towards the right-hand side in FIG. 1 and which is thus disposed coaxially relative to the casing front portion 14 and therewith the gripping portion 12 and the screwthreaded spindle 16.

Provided at the front end portion 50 of the screwthreaded spindle 16 is a coupling portion 52 which makes a connection between the screwthreaded spindle 16 and the closure body 46 in the interior of the casing front portion 14 when the gripping portion 12 is combined with a corresponding unused casing front portion 14.

FIG. 1 shows a view in longitudinal section of the applicator device 10 according to the invention in the original unused fresh condition in which the casing front portion 14 is covered and sealed off at its front end by a sealing cap 54 in order suitably to protect the stick 44 of spreadable material. The casing front portion 14 with the cap 54 is also covered by a protective cap 56 which provides in particular mechanical protection.

The casing front portion 14 is connected or connectable to the gripping portion 12 along a connecting portion 58 which is of a resiliently yielding nature. That resiliently yielding configuration is advantageously provided as illustrated by virtue of the presence of at least one longitudinal slot 60 which extends in the longitudinal direction of the applicator device 10. The protective cap 56 is also temporarily connected to the gripping portion 12 along the connecting portion 58. When the protective cap 56 is removed from the applicator device 10, the sealing cap 54 is also removed with the protective cap 56 from the casing front portion 14 so that the applicator device 10 is now in a reedy condition for applying the stick material to a suitable surface. When the front portion 62 of the stick 44, that projects out of the casing front portion 14, is used up, the stick 44 can be suitably advanced out of the casing front portion 14 by a screwing movement, for which purpose it is only necessary to produce rotary movement of the gripping portion 12 relative to the casing front portion 14, whereby the screwthreaded spindle 16 is suitably screwed along through the nut member 26 and is thus displaced towards the left in FIG. 1, thereby pushing the stick 44 of spreadable material towards the left in FIG. 1 and advancing it out of the applicator end of the applicator device.

Figure 2:
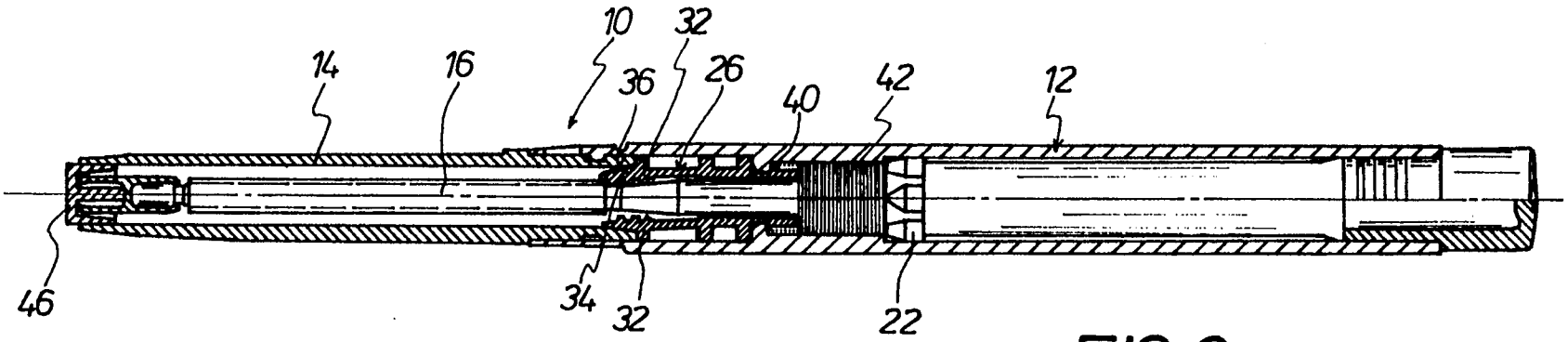
FIG. 2 is a view in longitudinal section through the applicator device shown in FIG. 1 after consumption of the whole of the stick of spreadable material which is cast into the casing front portion of the device.

Referring to FIG. 2, shown therein in longitudinal section is the applicator device 10 in an operating condition in which the stick of spreadable material as indicated at 44 in FIG. 1 has been entirely used up, that is to say, the piston-like closure body 4 6 has been screwed entirely into its forward position in the casing front portion 14. In that position therefore the screwthreaded spindle 16 has been screwed entirely forwardly through the nut member 26 so that the spring member 42 which is disposed around the screwthreaded spindle 16 between the front support portion 40 of the elongate gripping portion 12 and the rearward support portion 22 of the screwthreaded spindle 16 has been correspondingly compressed and is thus mechanically stressed. When now the casing front portion 14 is removed from the gripping portion 12, the connection between the coupling portion 36 of the casing front portion 14 and the plug-in portion 34 of the nut member 26 is released so that the mechanically stressed claw portions 32 which have been in a condition of having been forced radially inwardly can spring open, that is to say move radially away from each other and thus spread out, whereby the claw portions 32 come out of engagement with the screwthreaded spindle 16. This condition of disengagement can be clearly seen in respect of the claw portion 32 in the lower half of FIG. 2. By virtue of the claw portions 32 being disengaged from the screwthreaded spindle 16, it is possible for the screwthreaded spindle 16 to move back into the gripping portion 12 again, by virtue of the mechanical stressing of the spring element 4 2 which thus urges the screwthreaded spindle 16 rearwardly into the gripping portion 12, until the rearward support portion 22 of the screwthreaded spindle 16 again comes to bear against a corresponding contact shoulder as indicated at 64 in the gripping portion 12. The shoulder 64 may be formed for example by a rearward closure cap 66 of the gripping portion 12, as can be seen in particular in FIGS. 1 and 3.

Figure 3:
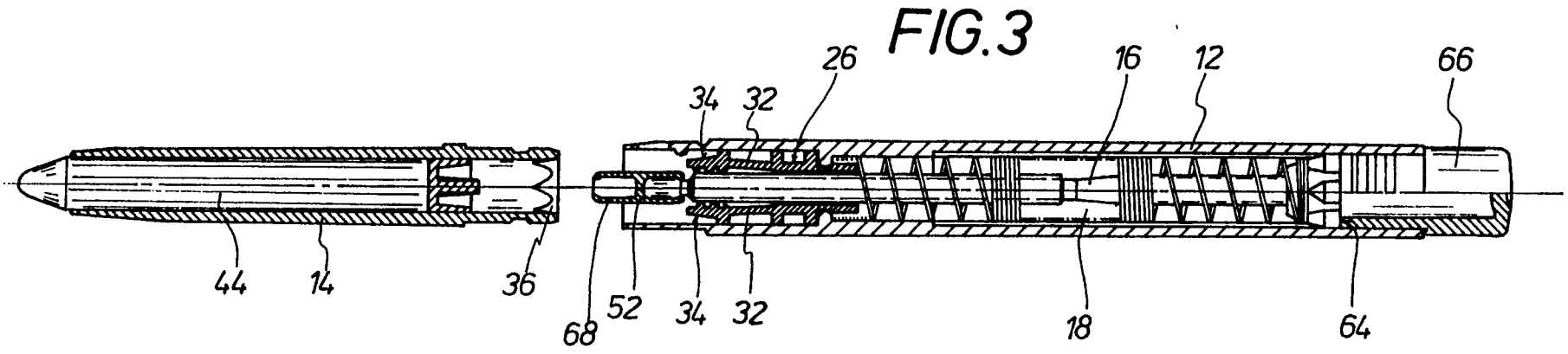
FIG. 3 is a view in longitudinal section through the applicator device showing the casing front portion with stick cast therein, separated from the elongate gripping portion of the applicator device.

In FIG. 3, the screwthreaded spindle 16 is shown in the interior 18 of the gripping portion 12, in its last-mentioned initial position in which it has been moved back into the gripping portion 12. In addition FIG. 3 shows a casing front portion 14 with stick 44 cast therein, in the unused and fresh original condition, before the casing front portion 14 is connected to the elongate gripping portion 12 to constitute the applicator device 10 when ready for use. The casing front portion 14 and the remainder of the applicator device 10 will thus be joined together by moving the two parts axially towards each other.

FIG. 3 also clearly shows the coupling portion 36 of the casing front portion 14, which in the assembled condition of the applicator device is non-rotatably connected to the plug-in portion 34 on the claw portions 32 of the nut member 26. FIG. 3 also shows that, when the gripping portion 12 is in the condition for fitting to the casing front portion 14, the coupling portion 52 at the end of the screwthreaded spindle 16 projects with a part 68 thereof out of the gripping portion 12, thereby improving centering of the casing front portion 14 relative to the gripping portion 12 when the two parts are being joined together.

Figure 4:
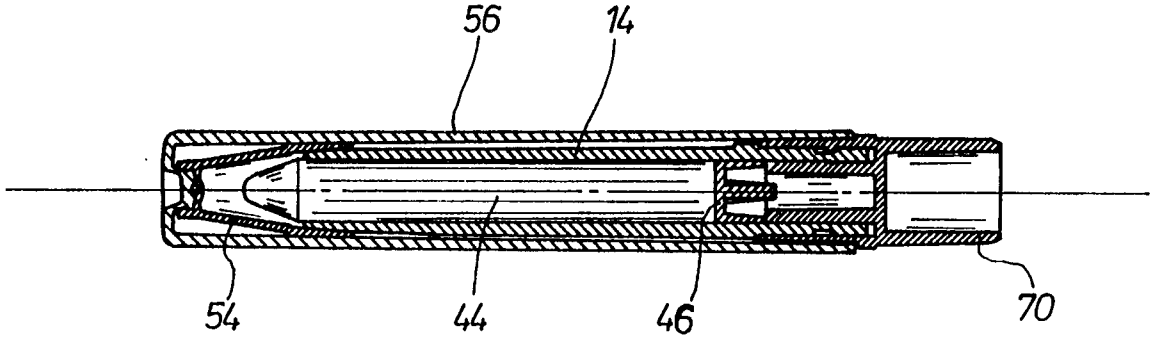
FIG. 4 is a view in longitudinal section through a replacement component consisting of the casing front portion with stick cast therein and protective cap thereon.

Looking now at FIG. 4, shown therein is a replacement casing front portion 14 in the original or new condition with a stick 44 of spreadable material cast therein, the piston-like closure body 46 in its original rearward position towards the right in FIG. 4, the cap 54 which seals off the casing front portion 14 at its front or applicator end, the protective cap 56 for protecting the casing front portion from mechanical influences and damage, and a rearward sealing element 70 which is fitted to the end of the casing front portion 14 that co-operates with the gripping portion 12, the sealing element 70 being removed from the casing front portion 14 when the latter is connected to the gripping portion 12 of the applicator device 10.

It will be appreciated that the above-described construction according to the invention has been set forth solely by way of example and illustration of the principles of the invention and that various modifications and alterations may be made therein without thereby departing from the spirit and scope of the invention.

What is claimed is:

1. An applicator device comprising: an elongate gripping portion; in said gripping portion a screwthreaded spindle disposed axially movably therein and an axially immovable nut means through which the screwthreaded spindle is screwable, the nut means having radially resilient screwthread claw means providing a plug-in portion and cooperable with the screwthread of the screwthreaded spindle; a casing front portion having a rearward end part which in the assembled condition of the applicator device is towards the gripping portion and said rearward end part having a coupling means for non-rotatable connection to said plug-in portion whereby said casing front portion is non-rotatably connected to said nut means and said casing front portion and said gripping portion are rotatable relative to each other in the assembled condition thereof in which said claw means are engaged into the screwthread of said screwthreaded spindle by said coupling means, said claw means being out of engagement with said screwthreaded spindle in the condition of the applicator device in which said casing front portion is removed from said gripping portion; a stick comprising a spreadable material which is cast into said casing front portion and which is adapted to be moved out of said casing front portion by means of said screwthreaded spindle; and a spring means operatively disposed in the gripping portion between a part thereof and said screwthreaded spindle and adapted to be mechanically stressed upon a forward feed movement of said screwthreaded spindle and operable to move said screwthreaded spindle back into a starting position into said gripping portion when said casing front portion is removed from said gripping portion.

2. An applicator device as set forth in claim 1 wherein the coupling means at the rearward end part of the casing front portion and the plug-in portion of the nut means have cross-sectional profiles which are adapted to each other in respect of shape and which differ from a circular shape, and generally conical longitudinal profiles which are adapted to each other in respect of shape.

3. An applicator device as set forth in claim 2 wherein said coupling means is of a polygonal cross-sectional profile and a longitudinal profile which enlarges rearwardly.

4. An applicator device as set forth in claim 1 wherein the casing front portion is closed at its rearward end part by means of a closure body which is arranged in the interior of the casing front portion displaceably therein and wherein the front end of the screwthreaded spindle has a coupling portion for connection to said closure body.

5. An applicator device as set forth in claim 4 wherein said closure body is of a piston-like configuration with a fixing projection for the coupling portion.

6. An applicator device as set forth in claim 4 wherein said screwthread spindle has a first support portion and said gripping portion has a second support portion, and wherein said spring means is operatively disposed between said first and second support portions around the screwthreaded spindle in such a way that said coupling portion projects out of the gripping portion when the casing front portion is removed from the gripping portion and thereby said claw means are out of engagement with the screwthreaded spindle, whereby the spring means can be mechanically relieved of stress by displacing the screwthreaded spindle into its said starting position.

7. An applicator device as set forth in claim 1 including a resiliently yielding connecting part for connection of said gripping portion to the casing front portion.

8. An applicator device as set forth in claim 7 wherein the connecting part is pert of the gripping portion and has at least one longitudinal slot.

9. An applicator device as set forth in claim 1 wherein the casing front portion is designed for a cast stick of a diameter of between about 2.5 and 5 millimeters.

10. An applicator device comprising: an elongate gripping portion having an axially extending elongate cavity therein; a screwthreaded spindle disposed in said cavity axially movably therein; means preventing said spindle from rotating relative to said gripping portion; a nut means in said cavity, the spindle extending screwably through said nut means, and the nut means having a plurality of axially extending radially resilient claw means providing a plug-in portion and meshingly cooperable with the screwthread of the spindle; a casing front portion having a rearward end part which in the assembled condition of the applicator device is towards the gripping portion, said rearward end part having a coupling means having an opening therein adapted to fit over said plug-in portion for non-rotatable connection to said plug-in portion on said nut means whereby said casing front portion is non-rotatably connected to said nut means and said casing front portion and said gripping portion are rotatable relative to each other in the assembled condition thereof in which said claw means are urged radially inwardly to engage into the screwthread of said spindle by said coupling means pressing inwardly on said plug-in portion, said claw means being released by said coupling means to move resiliently outwardly out of engagement with said spindle in the condition of the applicator device in which said casing front portion is removed from said gripping portion and said coupling means is disengaged from said plug-in portion; a stick comprising a spreadable material disposed in said casing front portion and adapted to be extended out of said casing front portion by rotation of said spindle; and a spring means operatively disposed in the gripping portion between a part thereof and said spindle and adapted to be mechanically stressed upon a forward feed movement of said spindle and operable to move said spindle back into a starting position into said gripping portion when said casing front portion is removed from said gripping portion.

* * * * *